US009988970B2

(12) United States Patent
Ohsawa et al.

(10) Patent No.: US 9,988,970 B2
(45) Date of Patent: Jun. 5, 2018

(54) SUCTION TUBE UNIT OF STRATIFIED SCAVENGING ENGINE

(71) Applicant: YAMABIKO CORPORATION, Ohme-Shi, Tokyo (JP)

(72) Inventors: Hisato Ohsawa, Fussa (JP); Takahiro Yamazaki, Akishima (JP); Hidekazu Tsunoda, Akishima (JP)

(73) Assignee: Yamabiko Corporation, Ohme-Shi, Tokyo (JP)

( * ) Notice: Subject to any disclaimer, the term of this patent is extended or adjusted under 35 U.S.C. 154(b) by 89 days.

(21) Appl. No.: 14/934,719

(22) Filed: Nov. 6, 2015

(65) Prior Publication Data

US 2016/0153346 A1 Jun. 2, 2016

(30) Foreign Application Priority Data

Nov. 28, 2014 (JP) ..... 2014-241907

(51) Int. Cl.

| | |
|---|---|
| ***F02B 25/20*** | (2006.01) |
| ***F02B 25/22*** | (2006.01) |
| ***F02M 7/06*** | (2006.01) |
| *F02M 35/10* | (2006.01) |
| *F02M 13/02* | (2006.01) |

(52) U.S. Cl.

CPC ..... *F02B 25/20* (2013.01); *F02B 25/22* (2013.01); *F02M 7/06* (2013.01); *F02M 35/1019* (2013.01); *F02M 35/10085* (2013.01); *F02M 35/10196* (2013.01); *F02M 13/021* (2013.01); *F02M 35/10314* (2013.01)

(58) Field of Classification Search

CPC ..... F02B 25/20; F02B 25/22; F02M 7/06; F02M 35/10085; F02M 13/021; F02M 35/10321

See application file for complete search history.

(56) References Cited

U.S. PATENT DOCUMENTS

| | | | | |
|---|---|---|---|---|
| 7,513,225 | B2 | 4/2009 | Geyer et al. | |
| 8,215,278 | B2 * | 7/2012 | Kummermehr | F02B 25/14 123/184.52 |
| 8,516,989 | B2 | 8/2013 | Schmidt et al. | |
| 2004/0244737 | A1 | 12/2004 | Araki et al. | |
| 2005/0045138 | A1 * | 3/2005 | Schmidt | F02B 25/22 123/184.46 |
| 2005/0120985 | A1 | 6/2005 | Rosskamp | |
| 2012/0152217 | A1 | 6/2012 | Grether et al. | |

OTHER PUBLICATIONS

Extended European Search Report issued in European Patent Application No. 15194410.5 dated Apr. 21, 2016.

* cited by examiner

*Primary Examiner* — Kevin A Lathers
(74) *Attorney, Agent, or Firm* — Baker & Hostetler LLP

(57) ABSTRACT

A suction tube unit connected between a cylinder block and a carburetor in a stratified scavenging engine has a suction tube for mixture made of an elastic material; and a suction tube for stratified scavenging air made of an elastic material. The suction tube for mixture and the suction tube for air have, at respective inlet ends connected to the carburetor, respective wall portions which face each other and have complementary shapes. A clearance space is provided between the wall portions of the suction tube for mixture and the suction tube for air.

7 Claims, 4 Drawing Sheets

SUCTION TUBE UNIT OF STRATIFIED SCAVENGING ENGINE

REFERENCE TO RELATED APPLICATIONS

This application claims the priority of Japanese Patent Application No. 2014-241907, filed Nov. 28, 2014, the entire contents of which are incorporated herein by reference.

TECHNICAL FIELD

The present invention relates to a stratified scavenging engine, and specifically to a suction tube unit connected between a cylinder block and a carburetor of a stratified scavenging engine.

BACKGROUND ART

A stratified scavenging engine is used in, for example, a chain saw, a brush cutter and an edge trimmer. In the stratified scavenging engine, mixture consisting of fuel and air, and stratified scavenging air are supplied to a cylinder block through respective suction tubes. Generally, the mixture produced in a carburetor is supplied to the cylinder block through a suction tube for mixture, while the stratified scavenging air is supplied to the cylinder block through a suction tube for air, which does not pass through the carburetor (refer to, for example, the Patent Publication 1).

On the other hand, another kind of stratified scavenging engine in which both of mixture and stratified scavenging air are supplied through a carburetor is known (refer to, for example, Patent Publication 2). In this carburetor of the stratified scavenging engine, one bore is formed, and a butterfly-type choke valve and a butterfly-type throttle valve are disposed in the one bore so that two passages are defined in the one bore when both of the valves are full-opened. Then, the mixture flows through the passage on one side of the full-opened valves (or the passage provided with a fuel injection aperture), while the stratified scavenging air flows through the passage on the other side.

In this kind of the stratified scavenging engine, a suction tube disposed between the cylinder block and the carburetor is a one suction tube into which a passage for mixture and a passage for air are integrated. Concretely, as shown in FIG. 5, an entire inlet cross-sectional profile of the suction tube 102 of the stratified scavenging engine 100 corresponds to a cross-sectional profile of a bore (not shown) of the carburetor (not shown), and the passage for mixture 106 and the passage for air 108 are defined by a common partition 104 in a thin plate form which aligns with the throttle valve in the fully-opened position. In this way, by integrating the passage for mixture 106 and the passage for air 108 into the one suction tube 102, the stratified scavenging engine 100 can be made compact.

Further, the suction tube is made of a rubber or a resin in order to prevent vibration and heat of the engine 100 from being transmitted to the carburetor. In a chain saw, the suction tube is typically made of a rubber.

SUMMARY OF THE INVENTION

When fuel, such as gasoline, passes through the passage for mixture 106, the partition 104 in the form of a thin plate made of a rubber is swelled. Since the partition 104 is fixed to a cylindrical material forming the one suction tube 102, the partition 104 is deformed so as to curve in an S-shape, as indicated by two-dot chain lines 104' in FIG. 5.

Further, since a negative pressure caused in the passage for mixture 106 becomes larger than a negative pressure caused in the passage for air 108 when a piston (not shown) in the engine 100 is lowered, the partition 104 made of an elastic material, such as a rubber, is entirely deformed so as to be pulled toward a side of the passage for mixture 106.

If such deformation of the partition 104 is caused, misalignment of the passage for mixture 106 and the passage for air 108 in the suction tube 102 with the passage for mixture and the passage for air in the carburetor would be caused so that when the mixture and the stratified scavenging air flow from the carburetor to the suction tube 102, they may be mixed with each other to form a mixed flow.

Further, since the cross-sectional profile of the passage for air 102 is changed due to such deformation of the partition 104 so as to influence the flow of the stratified scavenging air, a stratified scavenging operation may not be achieved as designed. Especially, a flow rate of the stratified scavenging air when the piston of the engine 100 is lowered may be shifted from a designed value.

It is therefore an object of the present invention to provide a suction tube unit which is compact, prevents the mixed-flow of the mixture and the stratified scavenging air, and restricts a change in the cross-sectional profile of the passage for air, and also to provide a stratified scavenging engine having the suction tube unit.

In order to achieve the above-stated object, a suction tube unit according to the present invention, which is connected between a cylinder block and a carburetor in a stratified scavenging engine, has a suction tube for mixture made of an elastic material; and a suction tube for stratified scavenging air made of an elastic material; wherein the suction tube for mixture and the suction tube for air have, at respective inlet ends connected to the carburetor, respective wall portions which face each other and have complementary shapes, and wherein a clearance space is provided between the wall portions of the suction tube for mixture and the suction tube for air.

In this suction tube unit, since the suction tube for mixture and the suction tube for air have respective wall portions facing each other and having complementary shapes, the suction tube for mixture and the suction tube for air are entirely configured to be unitary although they are separated from each other, so that the suction tube unit and the stratified scavenging engine can be arranged to be compact. Further, since the clearance space is provided between the wall portions of the suction tube for mixture and the suction tube for air, a deformation of the wall portion of the suction tube for mixture due to a swelling operation and/or a negative pressure is separated from a deformation of the wall portion of the suction tube for air. As a result, a mixed flow of the mixture and the stratified scavenging air can be prevented, and a change in the cross-sectional profile of the passage for air can be restricted.

In an embodiment of the suction tube unit according to the present invention, preferably, it further has an adapter disposed between the carburetor and the suction tube for mixture and between the carburetor and the suction tube for air, the adapter having a bore; wherein a single partition aligning with the wall portions of the suction tube for mixture and the suction tube for air is provided in the one bore, and the partition has a recess fitted to the wall portions of the suction tube for mixture and the suction tube for air.

In this suction tube unit, since the wall portions of the suction tube for mixture and the suction tube for air are positioned in the recess of the partition of the adapter, an effect of preventing the mixed-flow is enhanced, and the change in the cross-sectional profile of the passage for air can be further restricted.

In this embodiment of the suction tube unit according to the present invention, preferably, the adapter has a recess which receives the inlet end of the suction tube for mixture and the inlet end of the suction tube for air.

In this suction tube unit, the sealing performance between the suction tube unit and the carburetor can be enhanced.

In another embodiment of the suction tube unit according to the present invention, preferably, the wall portion of the suction tube for mixture has a reinforcing rib. In another embodiment, preferably, the suction tube for mixture and the suction tube for air are made of different materials. In another embodiment, preferably, the wall portion of the suction tube for mixture and the wall portion of the suction tube for air are planar.

In addition, in order to achieve the above-stated object, a stratified scavenging engine according to the present invention has the above-stated suction tube unit and a carburetor.

In an embodiment of the stratified scavenging engine according to the present invention, preferably, the carburetor has one bore connected to the suction tube for mixture and the suction tube for air, and the carburetor has a choke valve and a throttle valve disposed in the one bore.

According to the present invention, a suction tube unit which is compact, prevents a mixed-flow of mixture and stratified scavenging air, and restricts a change in a cross-sectional profile of a passage for air can be provided, and a stratified scavenging engine having the suction tube unit can be also provided.

DESCRIPTION OF EMBODIMENTS

Figure 1:
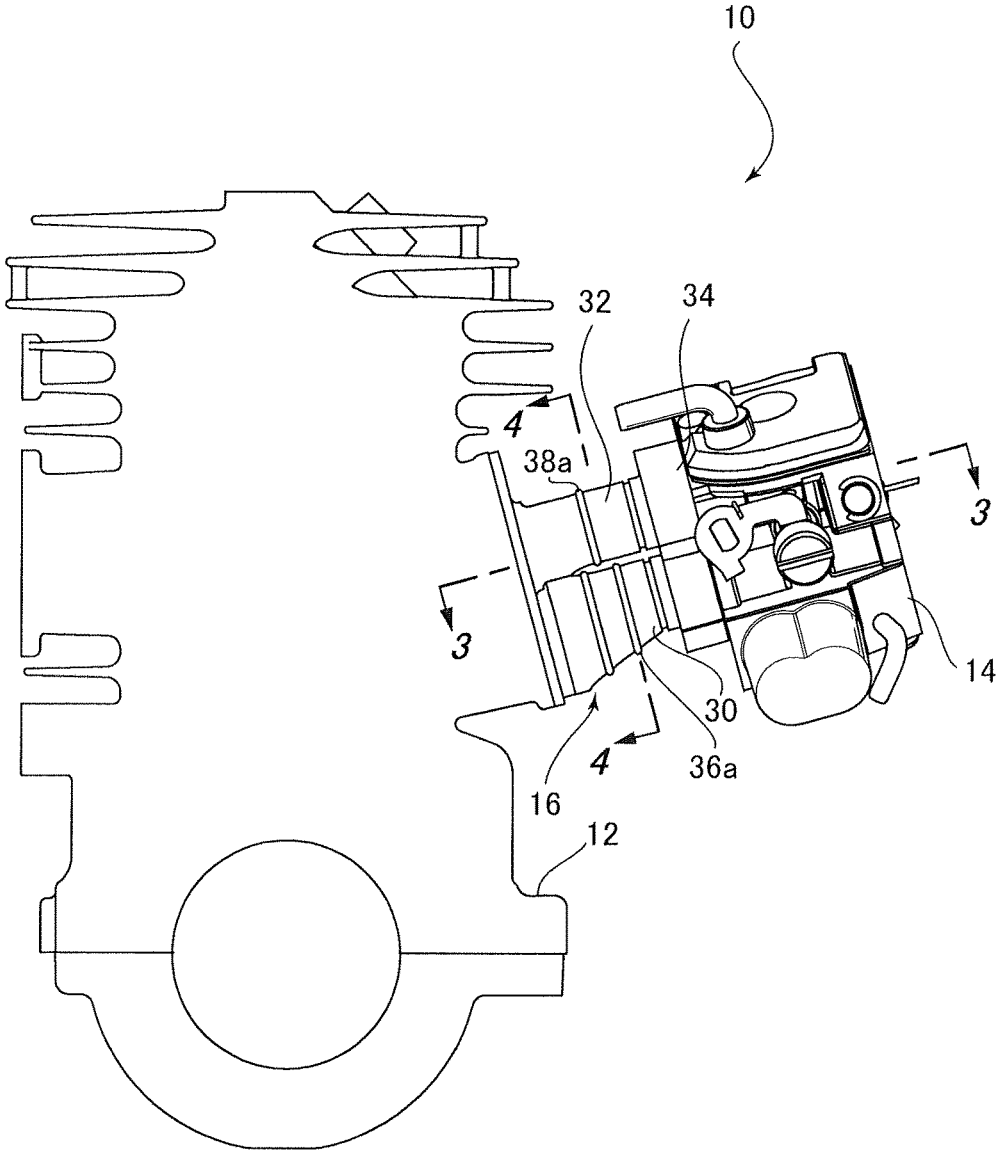
FIG. 1 is a schematic view of a stratified scavenging engine according to the present invention.

Referring to the drawings, an embodiment of a suction tube unit according to the present invention will be explained. As shown in FIG. 1, a stratified scavenging engine 10 has a cylinder block 12, a carburetor 14 and a suction tube unit 16 connected between the cylinder block 12 and the carburetor 14.

Figure 2:
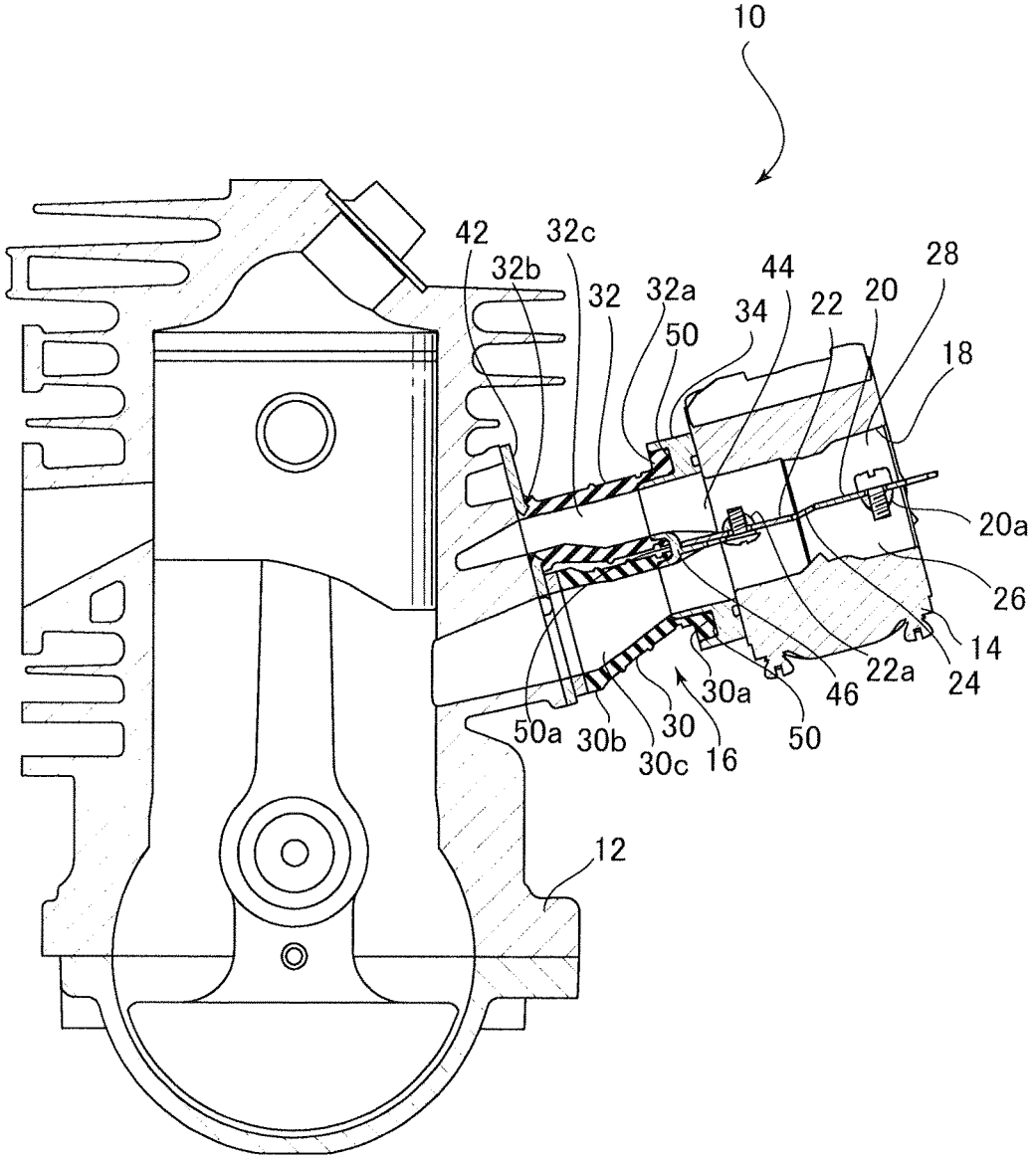
FIG. 2 is a cross-sectional view of the stratified scavenging engine according to the present invention.
Figure 3:
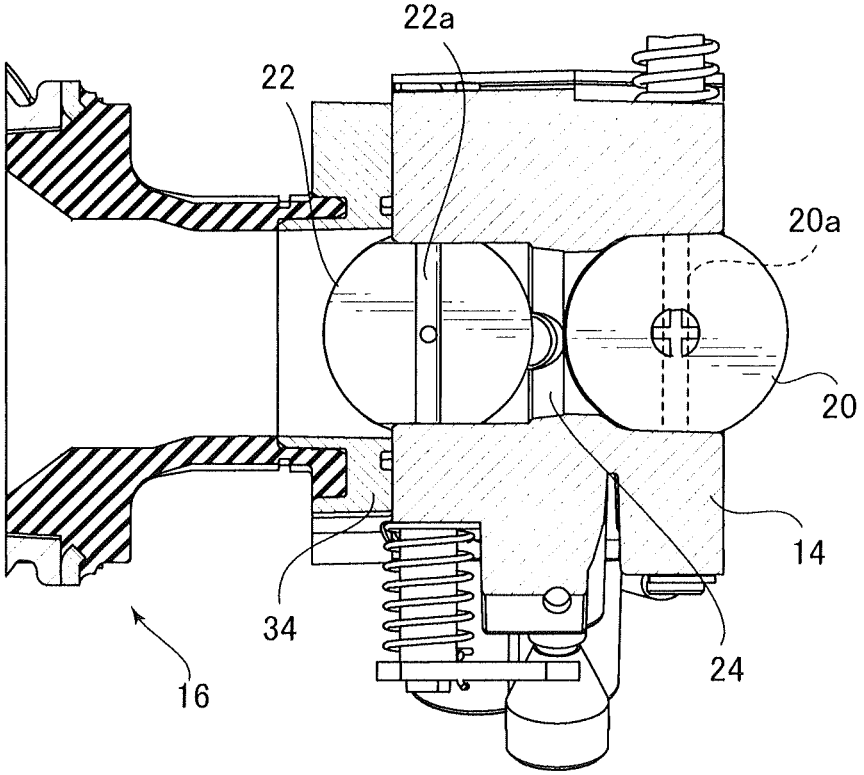
FIG. 3 is a cross-sectional view of a suction tube unit according to the present invention taking along a line 3-3 shown in FIG. 1.

As shown in FIGS. 2 and 3, the carburetor 14 has one through bore 18, a choke valve 20 and a throttle valve 22, the choke valve 20 and the throttle valve 22 being disposed in the one through bore 18. The one through bore 18 is connected to a suction tube for mixture 30 and a suction tube for air 32, which will be described later. The choke valve 20 and the throttle valve 22 are butterfly valves which rotate around respective axes 20*a*, 22*a*. The one through bore 18 has, for example, a circular cross section, and has a partition 24 between the choke valve 20 and the throttle valve 22, the partition 24 being aligned with the choke valve 20 and the throttle valve 22 when these valves 20 22 are in respective fully-opened positions. Thus, when the choke valve 20 and the throttle valve 22 are in the respective fully-opened positions, a passage for mixture 26 and a passage for air 28 are defined. Although the partition 24 is provided in the present embodiment, the partition 24 may be omitted when the choke valve 20 and the throttle valve 22 are arranged so as to form the passage for mixture 26 and the passage for air 28.

The suction tube unit 16 has a suction tube for mixture 30 connected to the passage for mixture 26 of the carburetor 14, a suction tube for air, namely, stratified scavenging air, 32 connected to the passage for air 28 of the carburetor 14, and an adapter 34 connecting the suction tube for mixture 30 and the suction tube for air 32 to the carburetor 14.

Figure 4:
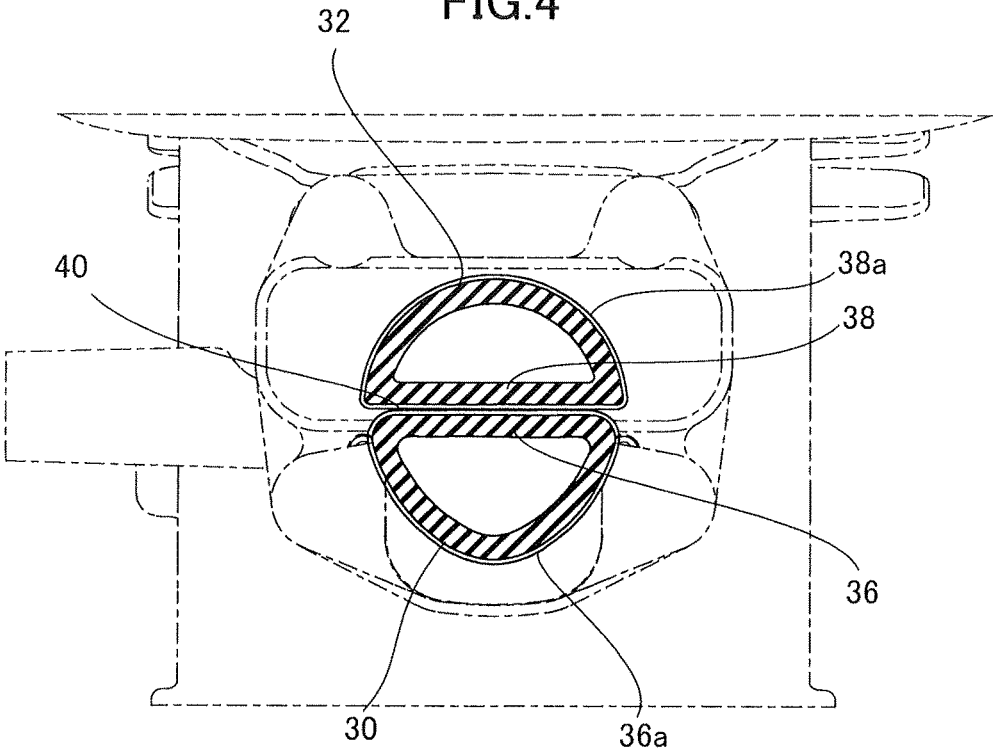
FIG. 4 is a cross-sectional view of the suction tube unit according to the present invention taking along a line 4-4 shown in FIG. 1.
Figure 5:
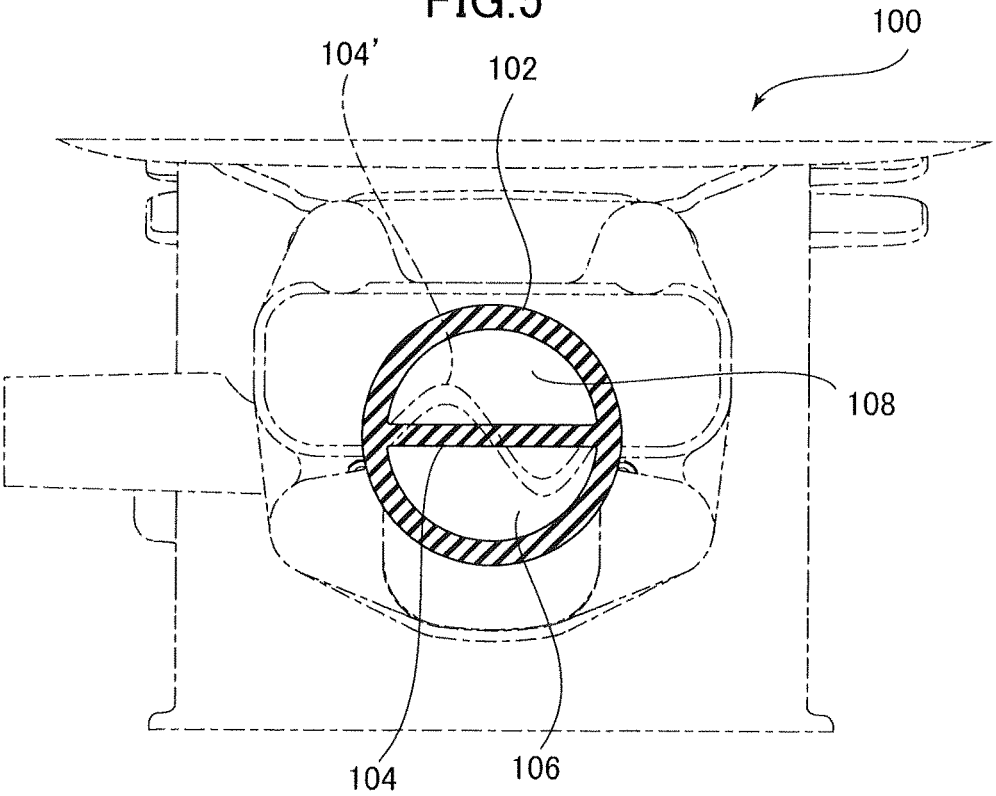
FIG. 5 is a cross-sectional view of a suction tube in prior art.

The suction tube for mixture 30 and the suction tube for air 32 are made of rubber, and as shown in FIG. 4, they do not have any common walls. Concretely, the suction tube for mixture 30 and the suction tube for air 32 have respective wall portions 36, 38 at respective inlet ends 30*a*, 32*a* connected to the carburetor 14, and the wall portions 36, 38 face each other and have complementary shapes, so that a clearance space 40 is provided between these wall portions 36, 38. In the present embodiment, both of the wall portion 36 of the suction tube for mixture 30 and the wall portion 38 of the suction tube for air 32 have planar-plate shapes. Reinforcing ribs 36*a*, 38*a* for preventing deformations of the wall portions 36, 38 may be provided on respective surfaces of the wall portions 36, 38 (in the present embodiment, around the suction tube for mixture 30 and the suction tube for air 32), the respective surfaces facing each other.

In the present embodiment, a cross-sectional profile of the inlet end 30*a* of a bore 30*c* of the suction tube for mixture 30 and a cross-sectional profile of the inlet end 32*a* of a bore 32*c* of the suction tube for air 32 are substantially semicircular. When the suction tube for mixture 30 and the suction tube for air 32 are incorporated into the stratified scavenging engine 10 as the suction tube unit 16, the suction tube for mixture 30 and the suction tube for air 32 are arranged so that the bores 30*c*, 32*c* totally (or collectively) define a substantially circular cross-sectional profile. This substantially circular cross-sectional profile substantially corresponds to the cross-sectional profile of the one through bore 18 of the carburetor 14.

A cross-sectional profile of an outlet end 30*b* of the bore 30*c* of the suction tube for mixture 30 and a cross-sectional profile of an outlet end 32*b* of the bore 32*c* of the suction tube for air 32 are arbitrarily determined. The suction tube for air 32 has a flange 42 at the outlet end 32*b* of the suction tube for air 32, the flange 42 being attached to the cylinder block 12. The outlet end 30*b* of the suction tube for mixture 30 is attached to the flange 42.

The adapter 34 is made of resign and has a bore 44. A cross-sectional profile of the bore 44 substantially corresponds to the cross-sectional profile of the one through bore 18 of the carburetor 14. A single partition 46 is provided in the bore 44, the partition 46 being aligned with both of the wall portion 36 of the suction tube for mixture 30 and the wall portion 38 of the suction tube for air 32, so that in the bore 44, a passage for mixture and a passage for stratified scavenging air are separated from each other. In the present embodiment, since the throttle valve 22 protrudes from the carburetor 14, the partition 46 is provided only at a downstream portion (on an engine side) of the bore 44 so that the throttle valve 22 abuts the partition 46. Further, the passage for mixture 26 and the passage for air 28 of the carburetor 14 are connected to the bore 30*c* (the passage) of the suction tube for mixture 30 and the bore 32*c* (the passage) of the suction tube for air 32, respectively.

The adapter 34 has a recess 50 which receives and fits to the inlet end 30*a* of the suction tube for mixture 30 and the inlet end 32*a* of the suction tube for air 32. Especially, both of the wall portions 36, 38 are fitted to a recess 50*a* of the partition 46. Due to this fitting, sealing at the inlet end 30*a* of the suction tube for mixture 30 and hermetically sealing at the inlet end 32*a* of the suction tube for air 32 are achieved. Further, communication between the suction tube for mixture 30 and the suction tube for air 32 is prevented.

Next, an operation of the embodiment of the suction tube unit according to the present invention will be explained.

When the choke valve 20 and the throttle valve 22 are in the respective fully-opened positions, a mixture flowing in the passage for mixture 26 of the carburetor 14 flows via the adapter 34 into the bore 30*c* of the suction tube for mixture 30, while an air flowing in the passage for air 28 of the carburetor 14 flows via the adapter 34 into the bore 32*c* of the suction tube for air 32.

A fuel component flowing in the suction tube for mixture 30 swells the wall portion 36 of the suction tube for mixture 30 made of rubber so that the cross-sectional profile of the inlet end 30*a* of the suction tube for mixture 30 is deformed. However, since the clearance space 40 is provided between the wall portion 36 of the suction tube for mixture 30 and the wall portion 38 of the suction tube for air 32, the cross-sectional profile of the bore 32*c* of the suction tube for air 32 is not influenced by the deformation of the cross-sectional profile of the suction tube for mixture 30.

Further, when a piston (not shown) of the engine 10 is lowered, the wall portion 36 of the suction tube for mixture 30 made of the rubber is deformed due to a negative pressure caused in the suction tube for mixture 30. However, since the clearance space 40 is provided between the wall portion 36 of the suction tube for mixture 30 and the wall portion 38 of the suction tube for air 32, the cross-sectional profile of the bore 32*c* of the suction tube for air 32 is not influenced by the deformation of the cross-sectional profile of the suction tube for mixture 30.

Thus, the flow in the suction tube for air 32 is that as designed, so that a predetermined stratified scavenging effect is surely achieved to enhance the rotation stability. Further, due to the clearance space 40, a heat dissipation performance of the suction tube unit 16 is enhanced so that transmitting heat of the engine 10 to the carburetor 14 is restricted.

The suction tube for mixture 30 and the suction tube for air 32 are positioned by fitting the inlet end 30*a* of the suction tube for mixture 30 and the inlet end 32*a* of the suction tube for air 32 to the recess 50 of the adapter. At the same time, hermetically sealing between the adapter 34 and the inlet ends 30*a*, 32*a* of the suction tube for mixture 30 and the suction tube for air 32 are surely achieved. Further, since the wall portion 36 of the suction tube for mixture 30 is fitted to the recess 50*a* of the adapter 34, the deformation of the wall portion 36 of the suction tube for mixture 30 is restricted. Even if the wall portion 36 is deformed, the sealing effect of the inlet end 30*a* of the suction tube for mixture 30 is maintained.

Since the reinforcing ribs 36*a*, 38*a* for preventing deformation of the wall portions 36, 38 are provided on the respective surfaces of the wall portions 36, 38, the respective surfaces facing each other, deformation of the entire cross-sectional profiles of the suction tube for mixture 30 and the suction tube for air 32 are restricted so that cross-sectional areas of the suction tube for mixture 30 and the suction tube for air 32 remain constant. Thus, variations of amounts of supplying mixture and air can be restricted.

Although the embodiment of the present invention has been explained, the present invention is not limited to the embodiment, and various modifications can be performed within the scope of the present invention recited in the claims. It goes without saying that such modified embodiments fall within the scope of the present invention.

Although the suction tube for mixture 30 and the suction tube for air 32 are made of rubber in the above-stated embodiment, they may be made of any elastic material. Further, a material of the suction tube for mixture 30 and a material of the suction tube for air 32 may be different from each other. For example, the suction tube for mixture 30 is made of a deformation-resistant material restricting deformation, while the suction tube for air 32 may be made of a material which is cheaper than that of the suction tube for mixture 30. Then, each of the passages of these tubes can be provided with a desirable function different from that of the other.

Although the suction tube for mixture 30 and the suction tube for air 32 are attached to the carburetor 14 via the adapter 34 in the above-stated embodiment, they may be attached to the carburetor 14 without using the adapter 34. In this case, for example, the carburetor 14 may be provided with recesses which receive the inlet end 30*a* of the suction tube for mixture 30 and the inlet end 32*a* of the suction tube for air 32.

Although the cross-sectional profile of the bore 30*c* of the inlet end 30*a* of the suction tube for mixture 30 and the cross-sectional profile of the inlet end 32*a* of the suction tube for air 32 are substantially semicircular in the above-stated embodiment, other cross-sectional profiles may be employed. Further, although the wall portion 36 of the suction tube for mixture 30 and the wall portion 38 of the suction tube for air 32 are substantially planar, they may be curved as long as they have complementary shapes.

The carburetor 14 may be a butterfly-valve type carburetor 14 as in the above-stated embodiment, or a rotary-valve type carburetor.

What is claimed:

1. A suction tube unit for a carburetor having one bore including a mixture-flow passage and a scavenging-air-flow passage, the passages being defined on opposite sides of a full-opened butterfly-type valve, the suction tube unit comprising:

a suction tube for mixture, the suction tube for mixture being made of an elastic material;

a suction tube for stratified scavenging air, the suction tube for air being made of an elastic material, and an adapter disposed between the carburetor and the suction tube for mixture and between the carburetor and the suction tube for air, wherein the suction tube for mixture and the suction tube for air have, at respective inlet ends connected to the adapter, respective wall portions which face each other and have complementary shapes, wherein a clearance space is provided between the wall portions of the suction tube for mixture and the suction tube for air, wherein the adapter has one bore, and wherein a single partition aligning with the wall portions of the suction tube for mixture and the suction tube for air is provided in the one bore, and the partition has a recess fitted to the wall portions of the suction tube for mixture and the suction tube for air.

2. The suction tube unit according to claim 1, wherein the adapter has a recess which receives the inlet end of the suction tube for mixture and the inlet end of the suction tube for air.

3. The suction tube unit according to claim 1, wherein the wall portion of the suction tube for mixture has a reinforcing rib.

4. The suction tube unit according to claim 1, wherein the suction tube for mixture and the suction tube for air are made of different materials.

5. The suction tube unit according to claim 1, wherein the wall portion of the suction tube for mixture and the wall portion of the suction tube for air are planar.

6. A stratified scavenging engine comprising:

a suction tube unit, comprising:

a suction tube for mixture, the suction tube for mixture being made of an elastic material;

a suction tube for stratified scavenging air, the suction tube for air being made of an elastic material, a carburetor having one bore including a mixture-flow passage and a scavenging-air-flow passage, the passages being defined on opposite sides of a full-opened butterfly-type valve, and an adapter disposed between the carburetor and the suction tube for mixture and between the carburetor and the suction tube for air, wherein the suction tube for mixture and the suction tube for air have, at respective inlet ends connected to the adapter, respective wall portions which face each other and have complementary shapes, wherein a clearance space is provided between the wall portions of the suction tube for mixture and the suction tube for air;

wherein the adapter has one bore; and wherein a single partition aligning with the wall portions of the suction tube for mixture and the suction tube for air is provided in the one bore, and the partition has a recess fitted to the wall portions of the suction tube for mixture and the suction tube for air.

7. The stratified scavenging engine according to claim 6, wherein the carburetor butterfly-type valve comprises a choke valve and a throttle valve.

* * * * *